US010377600B2

(12) United States Patent
Seo et al.

(10) Patent No.: US 10,377,600 B2
(45) Date of Patent: Aug. 13, 2019

(54) POST-PROCESSING APPARATUS AND IMAGE FORMING APPARATUS

(71) Applicant: FUJI XEROX Co., Ltd., Tokyo (JP)

(72) Inventors: Kyungin Seo, Incheon (KR); Soonyoung Kwon, Incheon (KR); Hyunchan Park, Incheon (KR); Yongho Choi, Incheon (KR)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/698,994

(22) Filed: Sep. 8, 2017

(65) Prior Publication Data

US 2018/0237252 A1 Aug. 23, 2018

(30) Foreign Application Priority Data

Feb. 23, 2017 (JP) ..... 2017-032141

(51) Int. Cl.

| | |
|---|---|
| ***B65H 31/10*** | (2006.01) |
| ***B42C 1/12*** | (2006.01) |
| ***B65H 31/14*** | (2006.01) |
| ***B65H 31/18*** | (2006.01) |
| *B65H 29/34* | (2006.01) |

(52) U.S. Cl.

CPC ..... *B65H 31/10* (2013.01); *B42C 1/12* (2013.01); *B65H 31/14* (2013.01); *B65H 31/18* (2013.01); *B65H 29/34* (2013.01); *B65H 2301/421* (2013.01); *B65H 2403/41* (2013.01); *B65H 2403/945* (2013.01); *B65H 2405/1117* (2013.01); *B65H 2405/11151* (2013.01); *B65H 2405/324* (2013.01); *B65H 2511/20* (2013.01); *B65H 2511/22* (2013.01); *B65H 2515/10* (2013.01); *B65H 2801/06* (2013.01); *B65H 2801/27* (2013.01)

(58) Field of Classification Search

CPC ..... B65H 31/04; B65H 31/10; B65H 29/34; B65H 2301/421; B65H 2301/4212; B65H 2801/06; B65H 2801/27

USPC ..... 270/58.13, 58.15, 58.28; 271/217, 219

See application file for complete search history.

(56) References Cited

U.S. PATENT DOCUMENTS

| | | | | |
|---|---|---|---|---|
| 3,912,255 A * | 10/1975 | McInerny | ..... | G06M 7/06 271/177 |
| 4,838,480 A * | 6/1989 | Takahashi | ..... | B65H 1/18 109/24.1 |
| 5,322,275 A * | 6/1994 | Gardellini | ..... | B65H 29/38 271/176 |

(Continued)

FOREIGN PATENT DOCUMENTS

JP 2008-285268 A 11/2008

OTHER PUBLICATIONS

Espacenet machine translation of JP2008285268; obtained Mar. 30, 2018; http://translationportal.epo.org/emtp/translate/?ACTION=description-retrieval&COUNTRY=JP&ENGINE=google&FORMAT=docdb&KIND=A&LOCALE=en_EP&NUMBER=2008285268&OPS=ops.epo.org/3.2&SRCLANG=ja&TRGLANG=en.*

*Primary Examiner* — Leslie A Nicholson, III

(74) *Attorney, Agent, or Firm* — Sughrue Mion, PLLC

(57) ABSTRACT

A post-processing apparatus includes an ejection tray receiving a recording medium that is ejected, an elastic member urging the ejection tray upward in a vertical direction, a moving mechanism causing the ejection tray to move up and down in the vertical direction, and a driving source driving the moving mechanism.

9 Claims, 9 Drawing Sheets

(56) References Cited

U.S. PATENT DOCUMENTS

| | | | | | |
|---|---|---|---|---|---|
| 5,984,299 | A * | 11/1999 | Hirota | B65H 31/14 | 271/161 |
| 6,244,589 | B1 * | 6/2001 | Gerlier | B65H 29/44 | 271/177 |
| 6,663,102 | B2 * | 12/2003 | Takahashi | B65H 31/10 | 271/213 |
| 6,685,180 | B2 * | 2/2004 | Saegusa | B65H 31/00 | 270/58.08 |
| 6,736,393 | B2 * | 5/2004 | Noh | B65H 31/10 | 271/214 |
| 7,946,576 | B2 * | 5/2011 | Deaville | B65H 29/00 | 194/206 |

* cited by examiner

POST-PROCESSING APPARATUS AND IMAGE FORMING APPARATUS

CROSS-REFERENCE TO RELATED APPLICATIONS

This application is based on and claims priority under 35 USC 119 from Japanese Patent Application No. 2017-032141 filed Feb. 23, 2017.

BACKGROUND

(i) Technical Field

The present invention relates to a post-processing apparatus and an image forming apparatus.

(ii) Related Art

In a post-processing apparatus and an image forming apparatus that perform a printing operation and post-processing on a printing sheet and eject the printing sheet, an ejection tray is provided in such a manner as to receive, for example, an ejected printing sheet.

In such apparatuses, in order to increase the number of recording media, such as ejected printing sheets, that are stackable on an ejection tray, the position of the ejection tray may sometimes be controlled in accordance with the number of the recording media stacked thereon by enabling the position of the ejection tray to move up and down.

However, in the case of enabling the ejection tray to move up and down by applying only a driving force with a driving source, such as a motor, the driving source needs to be capable of producing a driving force large enough for the ejection tray to move up and down, even in a state where the maximum stackable number of printing sheets or stacks of printing sheets are stacked on the ejection tray.

SUMMARY

According to an aspect of the invention, there is provided a post-processing apparatus including an ejection tray receiving a recording medium that is ejected, an elastic member urging the ejection tray upward in a vertical direction, a moving mechanism causing the ejection tray to move up and down in the vertical direction, and a driving source driving the moving mechanism.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described in detail below with reference to the drawings.

Figure 1:
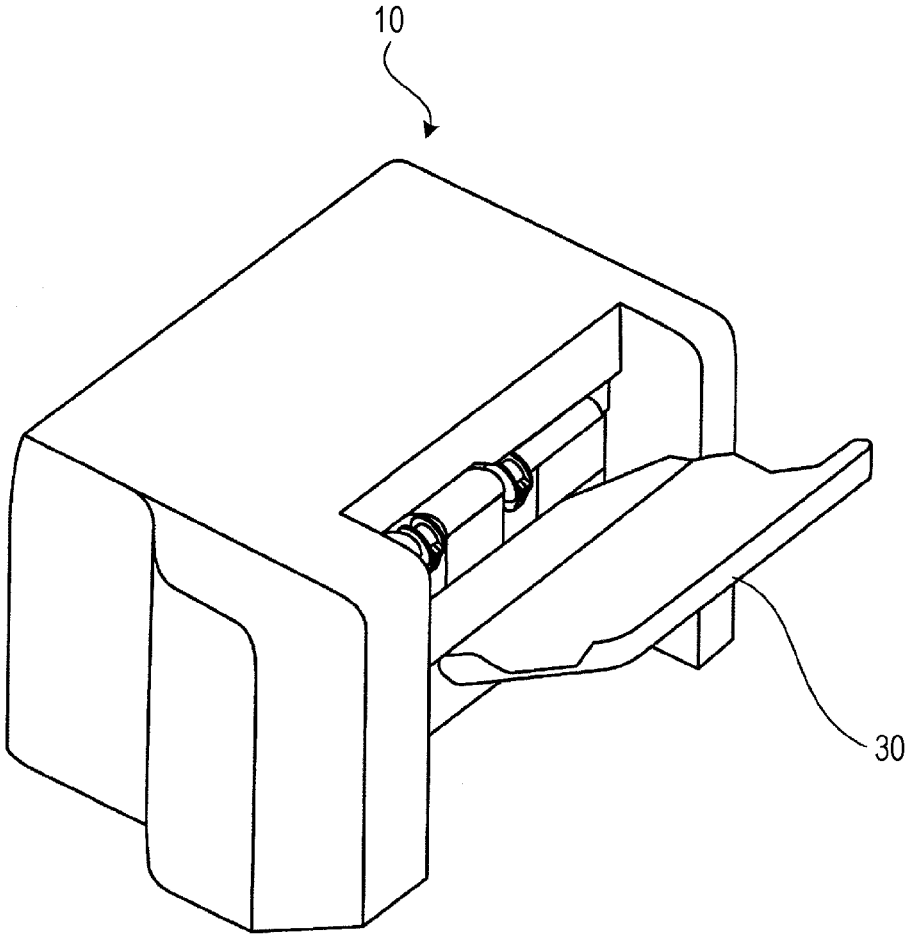
FIG. 1 is a diagram illustrating the configuration of a post-processing apparatus according to an exemplary embodiment of the present invention.

FIG. 1 is a perspective view illustrating the appearance of a post-processing apparatus 10 according to an exemplary embodiment of the present invention.

As illustrated in FIG. 1, the post-processing apparatus 10 according to the exemplary embodiment of the present invention has a shape such that the post-processing apparatus 10 is used by being connected to a printer. The post-processing apparatus 10 has a function of performing post-processing, such as stapling, on plural printing sheets ejected from the printer and then ejecting a stack of the printing sheets, on which the post-processing has been performed, to an ejection tray 30.

Figure 2:
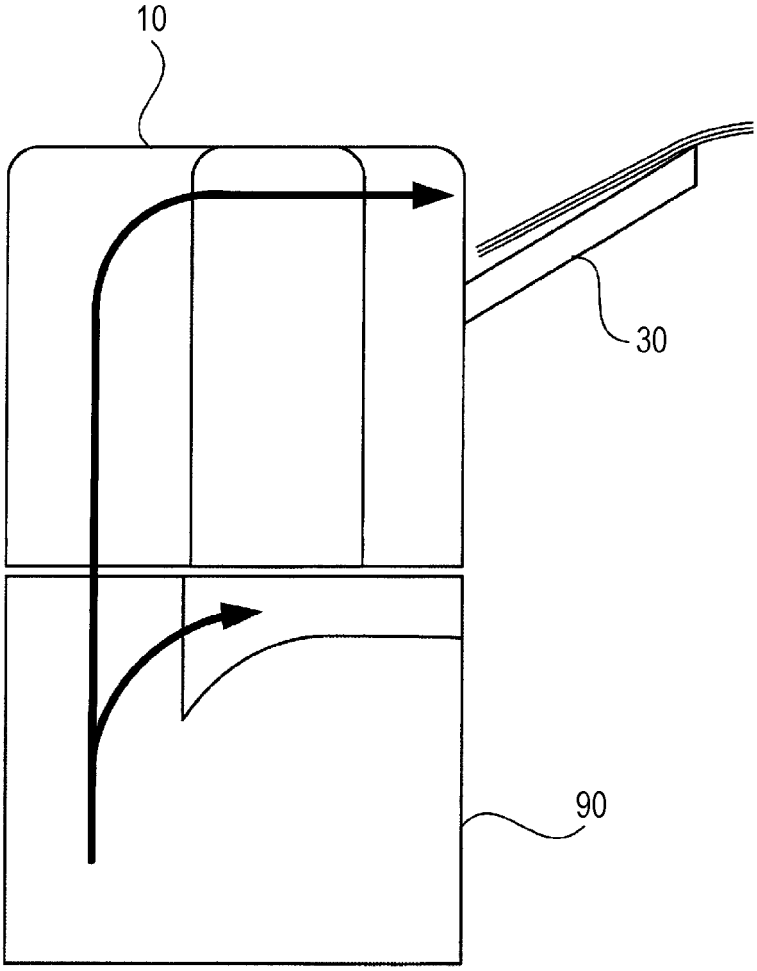
FIG. 2 is a diagram illustrating a state in which the post-processing apparatus according to the exemplary embodiment of the present invention is used by being connected to a printer.

A state in which the post-processing apparatus 10 is used by being connected to a printer 90 is illustrated in FIG. 2.

FIG. 2 illustrates a state in which the post-processing apparatus 10 ejects, to the ejection tray 30, a stack of printing sheets obtained by performing the post-processing, such as stapling, on printing sheets that are ejected from the printer 90 and introduced into the post-processing apparatus 10.

Figure 3:
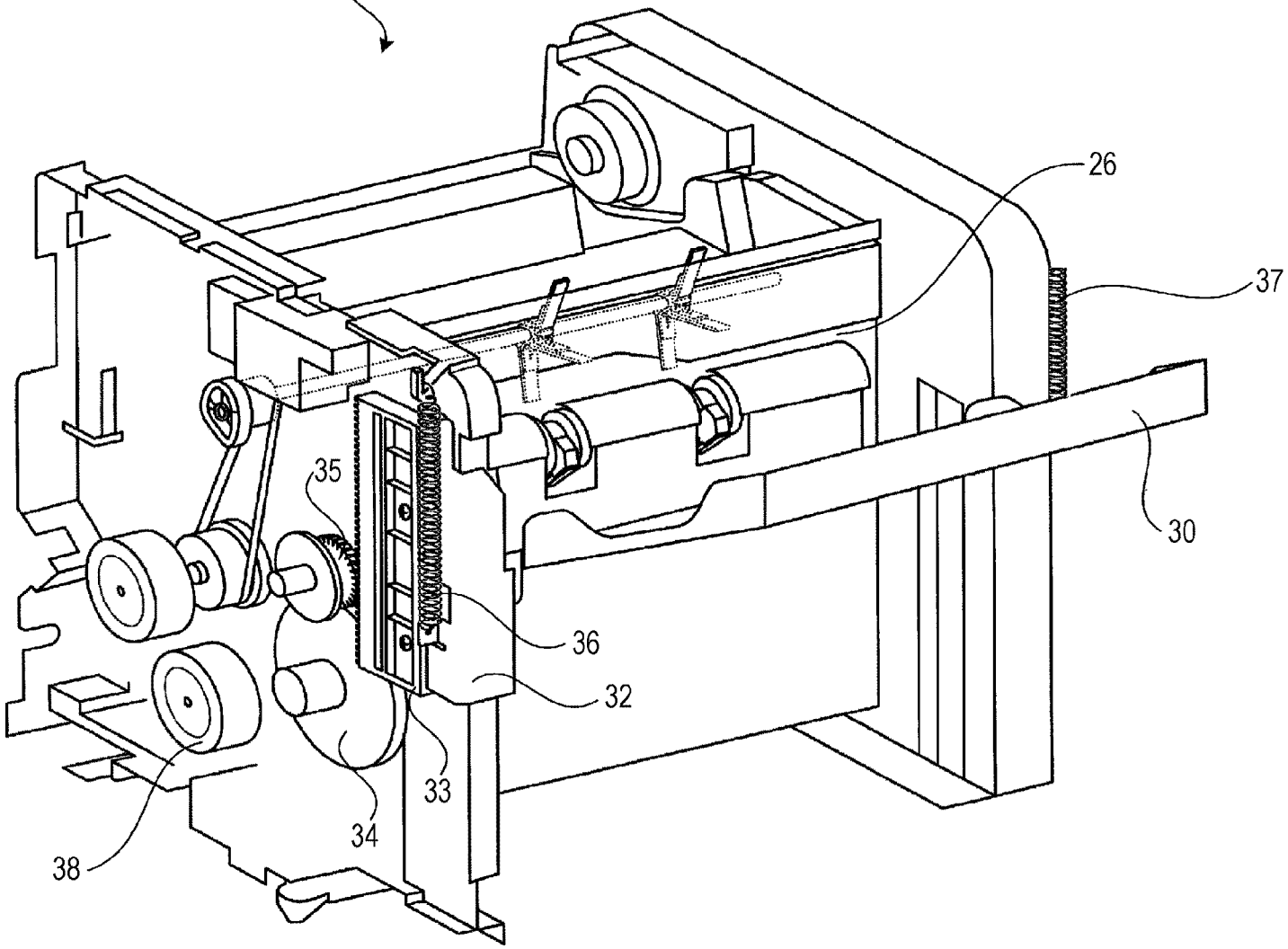
FIG. 3 is a perspective view illustrating the internal structure of the post-processing apparatus according to the exemplary embodiment of the present invention from which a side-surface cover and a top-surface cover have been removed.

FIG. 3 is a perspective view illustrating the internal structure of the post-processing apparatus 10 according to the present exemplary embodiment from which a side-surface cover and a top-surface cover have been removed.

FIG. 3 illustrates a structure for controlling vertical movement of the ejection tray 30 that receives a recording medium such as a printing sheet ejected from an ejection port 26. Referring to FIG. 3, a holding plate 32, a rack member 33, and gears 34 and 35 are illustrated as a moving mechanism that causes the ejection tray 30 to move up and down in the vertical direction. A motor 38 is provided as a driving source that drives the moving mechanism.

The ejection tray 30 is fixed to the holding plate 32 and the rack member 33. The holding plate 32 is raised upward in the vertical direction and urged by a spring 36. In other words, the ejection tray 30 is urged upward in the vertical direction as a result of being raised by the spring 36, which is an elastic member. Note that the post-processing apparatus 10 is also provided with a spring 37 on the side opposite to the side on which the spring 36 is disposed, and a portion of the ejection tray 30, the portion being opposite to a portion of the ejection tray 30 that is urged by the spring 36, is also urged upward in the vertical direction by the spring 37.

When the motor 38 rotates, the gears 34 and 35 are driven so as to rotate. The rack member 33 has teeth that engage the gear 35 and is configured to move in the vertical direction along with rotation of the gear 35.

In the case where the moving mechanism, which is formed of the holding plate 32, the rack member 33, the gears 34 and 35, and the like, is not driven by the motor 38, the position of the ejection tray 30 moves in accordance with the total weight of the ejection tray 30 and printing sheets placed on the ejection tray 30.

A worm gear is a known example of the moving mechanism that causes the position of the ejection tray 30 not to move, even in a state where supply of power to the motor 38 is discontinued. In such a moving mechanism, the position of an ejection tray is controlled by using a worm gear having a large speed reduction ratio, so that the downward movement of the ejection tray may be hindered only by the moving mechanism.

However, the structure of a moving mechanism that uses a worm gear is complex, and thus, there has been a problem in that the manufacturing costs are high.

Accordingly, the post-processing apparatus 10 according to the present exemplary embodiment employs a moving mechanism that uses the normal gears 34 and 35 so as to simplify the structure of the moving mechanism and achieves a reduction in the manufacturing costs.

However, with such a moving mechanism that uses normal gears 34 and 35, as described above, when supply of power to the motor 38 is discontinued, there is a possibility that the position of the ejection tray 30 will move.

Consequently, the post-processing apparatus 10 according to the present exemplary embodiment includes a detector that detects the position of the ejection tray 30 when the ejection tray 30 moves up and down.

Figure 4:
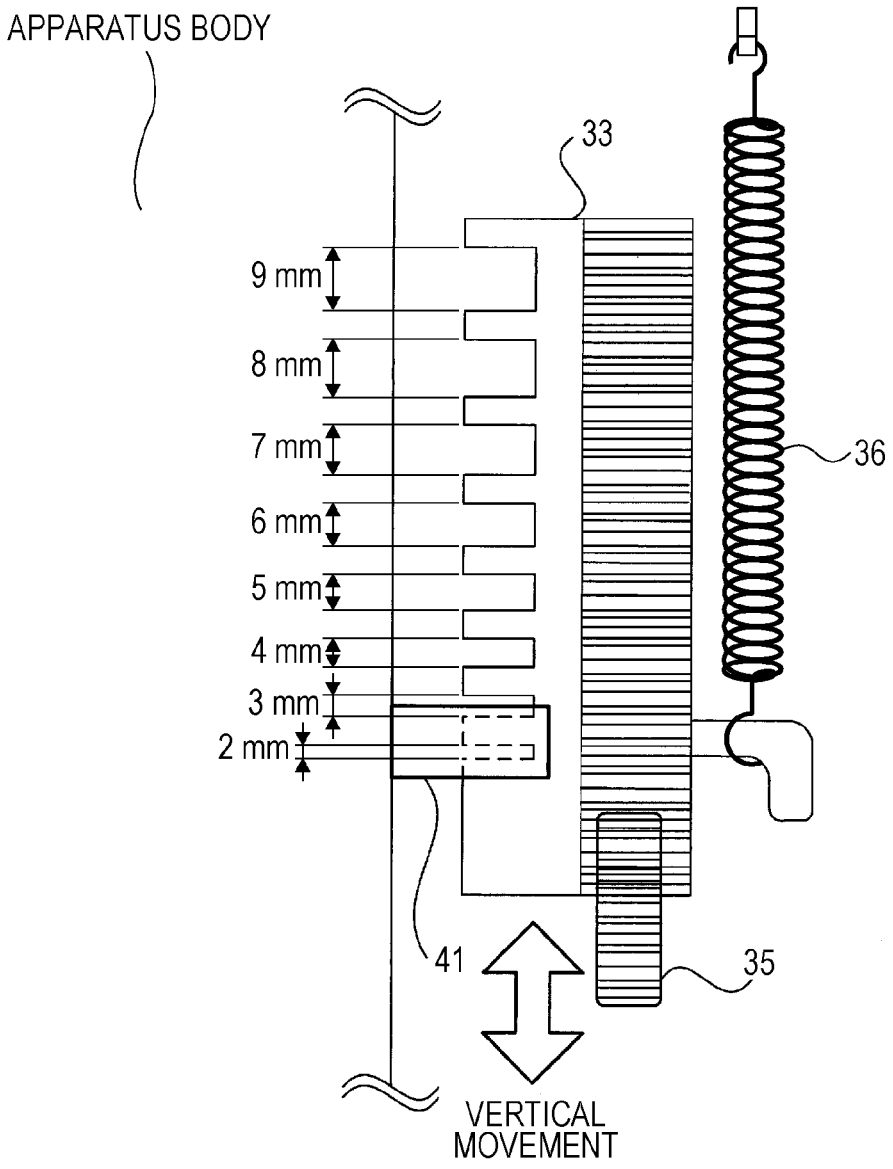
FIG. 4 is a diagram illustrating a structure for detecting the position of an ejection tray by using a rack member that moves along with vertical movement of the ejection tray.

More specifically, as illustrated in FIG. 4, the rack member 33 that moves along with the vertical movement of the ejection tray 30 has plural holes having different widths. An optical sensor 41 that measures the widths of the plural holes of the rack member 33 is fixed to an apparatus body.

In other words, the rack member 33 and the optical sensor 41 form the detector, which detects the position of the ejection tray 30.

Figure 5:
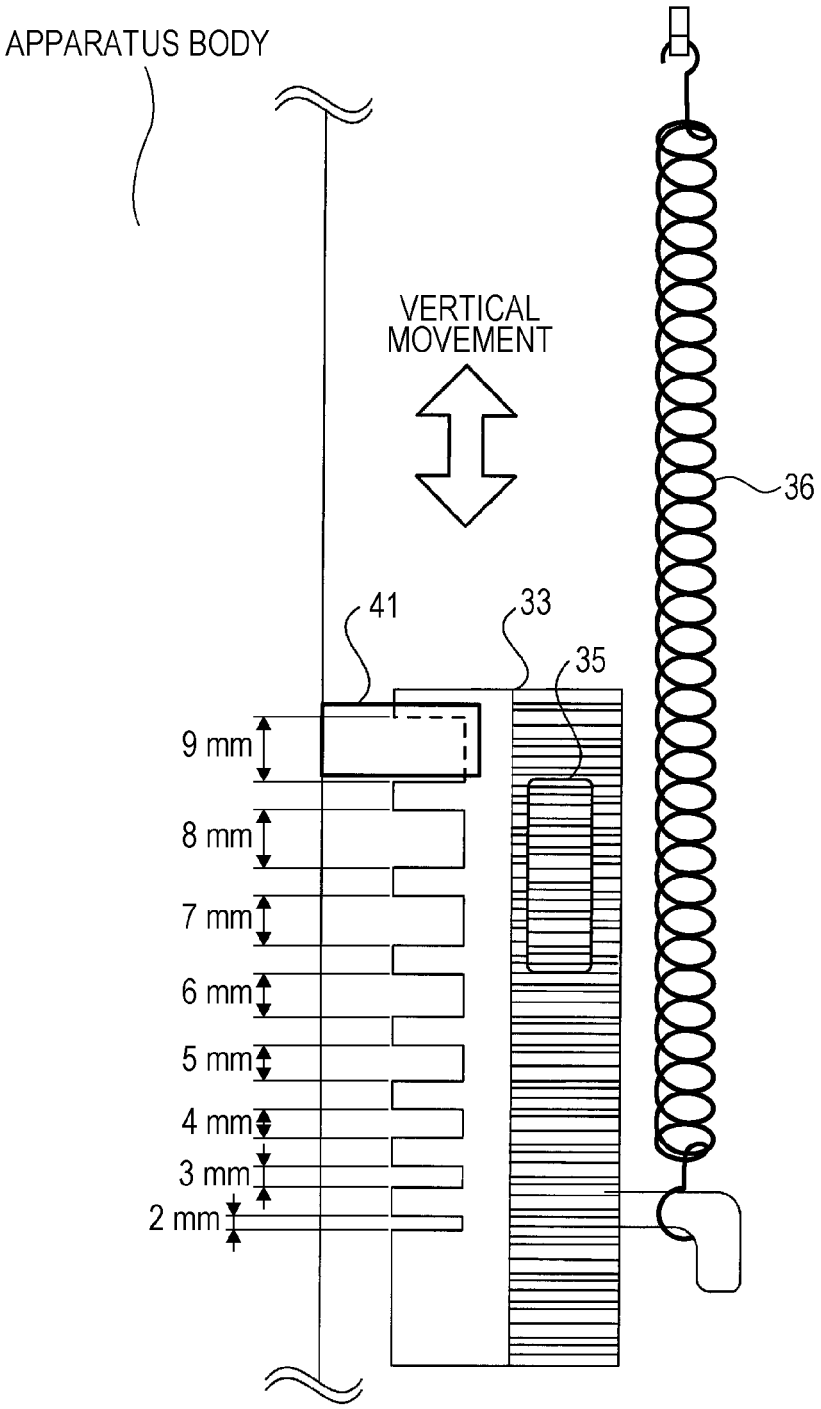
FIG. 5 is a diagram illustrating a state in which the ejection tray is lowered to the lowermost position.

More specifically, when the rack member 33 is caused to move up and down by operating the gear 34, the current position of the ejection tray 30 may be determined from the width of one of the holes detected by the optical sensor 41. That is to say, for example, in the case where the ejection tray 30 is located at a position illustrated in FIG. 4, the width of the hole that is detected is 2 mm, and in the case where the ejection tray 30 is lowered to the lowermost position as illustrated in FIG. 5, the width of the hole that is detected is 9 mm.

Figure 6:
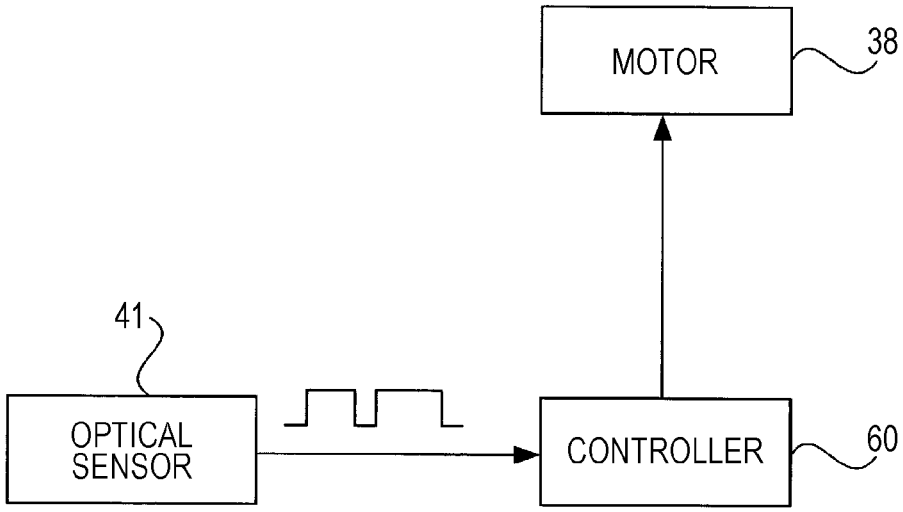
FIG. 6 is a diagram illustrating a state in which a controller detects the position of the ejection tray by using a detection signal from an optical sensor and controls the position of the ejection tray.

As illustrated in FIG. 6, the controller 60 that controls the position of the ejection tray 30 in the manner described above estimates the position of the ejection tray 30, that is, the weight of the printing sheets stacked on the ejection tray 30 by using a detection signal from the optical sensor 41 and controls the vertical movement of the ejection tray 30.

In other words, in the case where supply of power to the motor 38 is discontinued and then restarted, the controller 60 estimates the total weight of printing sheets stacked on the ejection tray 30 on the basis of the position detected by the optical sensor 41 and controls the vertical movement of the ejection tray 30.

Figure 7:
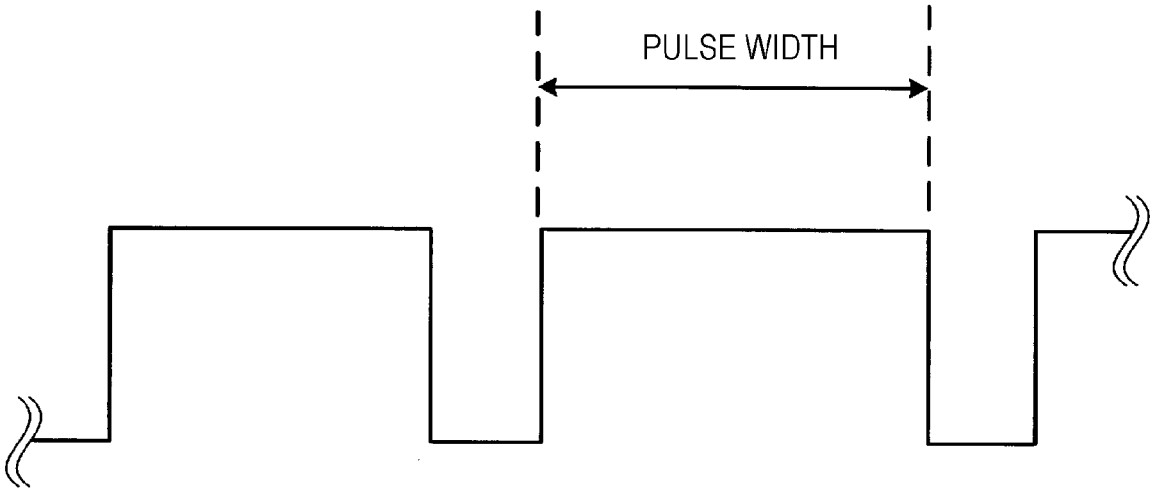
FIG. 7 is a diagram illustrating a detection signal output by the optical sensor.

More specifically, the controller 60 detects the position of the ejection tray 30 by measuring the pulse width of a pulsed detection signal from the optical sensor 41 as illustrated in FIG. 7 and by determining, from the moving speed of the motor 38, which one of the holes of the rack member 33 corresponds to the pulse width.

In the case where the motor 38 is a stepping motor and where the controller 60 controls the motor 38 by outputting a pulsed signal to the motor 38, the controller 60 measures the pulse width of a detection signal from the optical sensor 41 by counting the number of pulses output to the motor 38.

Note that a configuration for detecting the position of the ejection tray 30 is not limited to the above-described configuration, and any configuration may be employed as long as the configuration enables detection of the position of the ejection tray 30.

A driving force of the motor 38 that is required for raising the ejection tray 30 and a driving force of the motor 38 that is required for lowering the ejection tray 30 will now be described with reference to FIG. 8 and FIG. 9, respectively.

Figure 8:
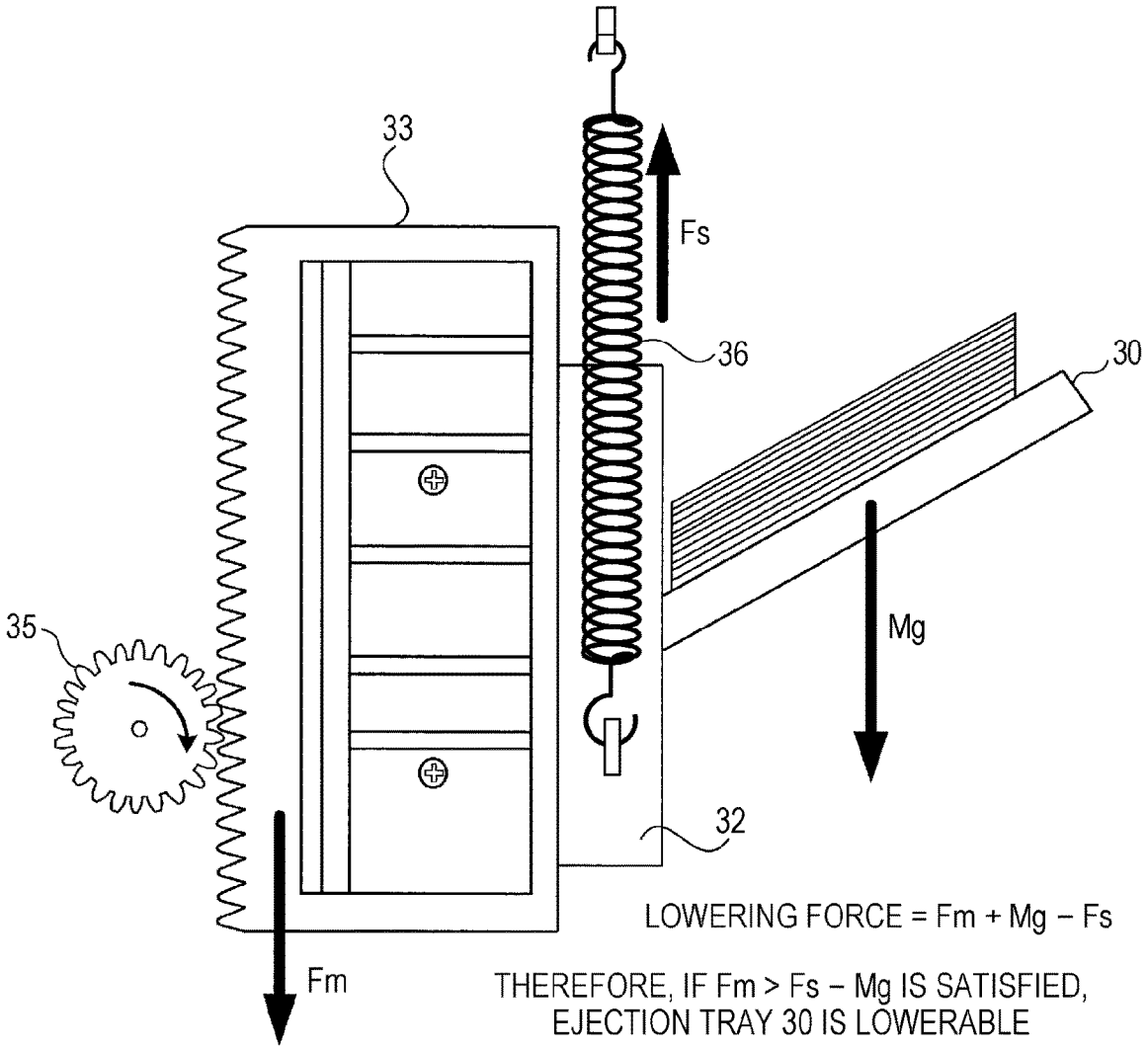
FIG. 8 is a diagram illustrating a driving force of a motor that is required for lowering the ejection tray.
Figure 9:
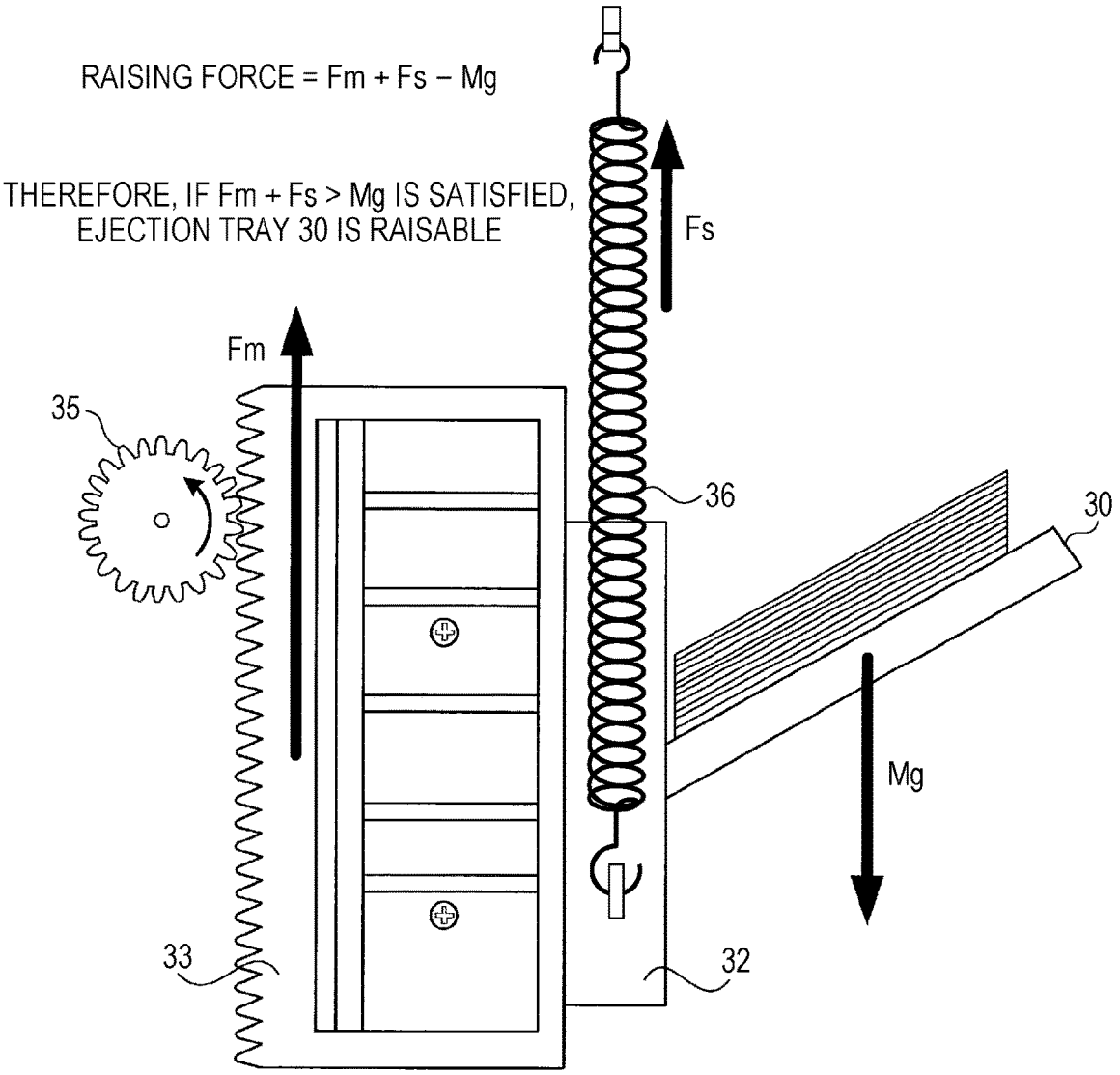
FIG. 9 is a diagram illustrating a driving force of the motor that is required for raising the ejection tray.

In FIG. 8 and FIG. 9, a force that drives the rack member 33, the force being generated by the gear 35 rotating as a result of the motor 38 being driven, is denoted by Fm, and a force that pulls the holding plate 32 upward, the force being generated by the spring 36, is denoted by Fs. In addition, a force that pulls the ejection tray 30 downward in the vertical direction, the force being generated by the total weight of the ejection tray 30 and printing sheets stacked on the ejection tray 30, is denoted by Mg.

A case of performing a lowering operation for causing the ejection tray 30 to move downward will be described first with reference to FIG. 8.

When the lowering operation is performed, the largest driving force of the motor 38 is required in the case where the weight of the printing sheets is small. That is to say, the load applied to the motor 38 becomes maximum.

In this case, the lowering force is expressed by the following equation 1.

$$\text{lowering force} = Fm + Mg - Fs \quad \text{(Equation 1)}$$

The ejection tray 30 moves downward as the number of printing sheets stacked on the ejection tray 30 increases, and the pulling force Fs of the spring 36 gradually increases. When the force Fm of the motor 38 in a downward direction is larger than a force (Fs−Mg) obtained by subtracting the force Mg corresponding to the total weight of the ejection tray 30 and the printing sheets from the pulling force Fs of the spring 36, the ejection tray 30 may be lowered.

A case of performing a raising operation for causing the ejection tray 30 to move upward will now be described with reference to FIG. 9.

When the raising operation is performed, the largest driving force of the motor 38 is required in the case where the weight of the printing sheets is large. That is to say, the load applied to the motor 38 becomes maximum.

In this case, the raising force is expressed by the following equation 2.

$$\text{raising force} = Fm + Fs - Mg \quad \text{(Equation 2)}$$

Referring to Equation 2, it is understood that the ejection tray 30 and the printing sheets are pulled upward by the sum of the force Fm of the motor 38 in an upward direction and the pulling force Fs of the spring 36. In other words, when the total force (Fm+Fs) of the force Fm of the motor 38 in the upward direction and the pulling force Fs of the spring 36 is larger than the force Mg corresponding to the total weight of the ejection tray 30 and the printing sheets, the ejection tray 30 may be raised.

A folding structure of the ejection tray 30 will now be described with reference to FIG. 10.

Figure 10:
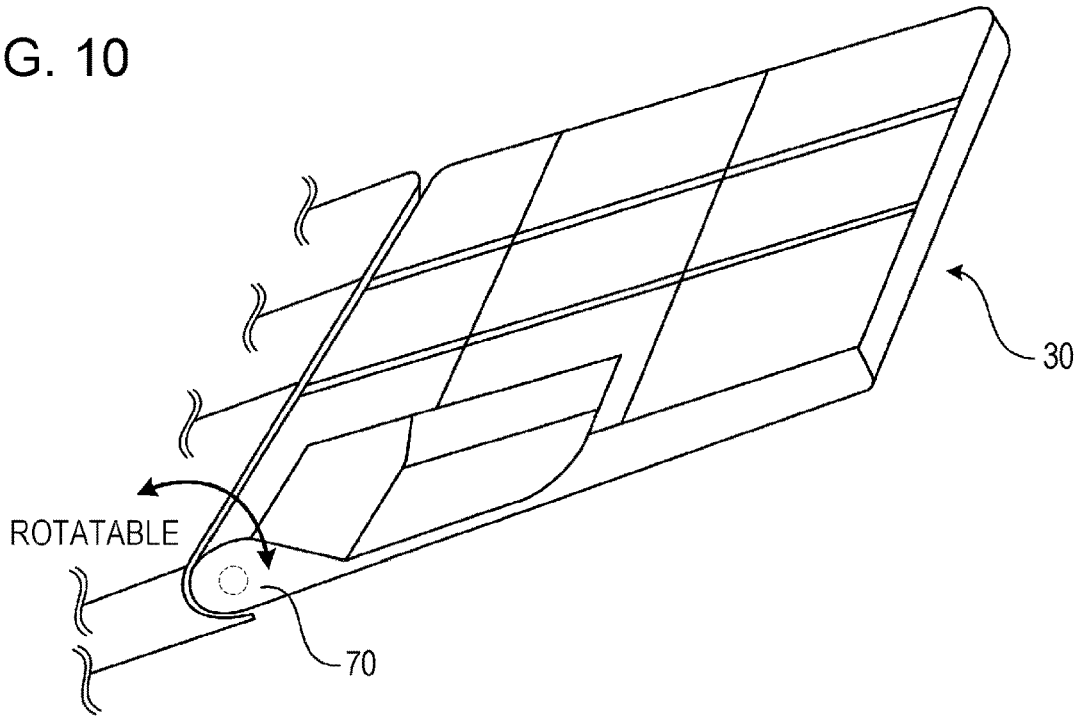
FIG. 10 is a diagram illustrating a folding structure of the ejection tray.

As illustrated in FIG. 10, the ejection tray 30 is attached to the holding plate 32 and the like, which form the moving mechanism, by a hinge structure 70 that enables the ejection tray 30 to be folded to the side on which the apparatus body is present. The hinge structure 70 is fixed in place in a state where the ejection tray 30 is folded to the side on which the apparatus body is present and in a state where the ejection tray 30 is ready to receive an ejected printing sheet.

Figure 11:
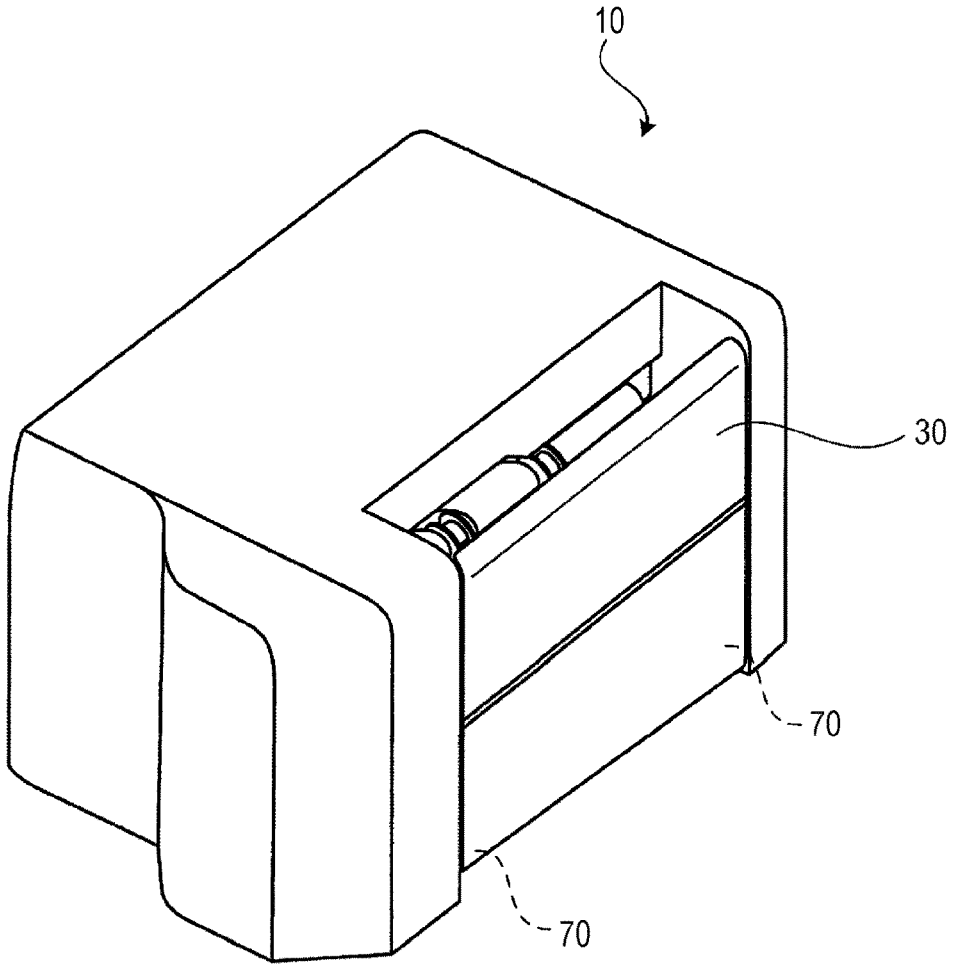
FIG. 11 is a diagram illustrating a state where the ejection tray is folded to the side on which an apparatus body is present.

Consequently, for example, when the post-processing apparatus 10 according to the present exemplary embodiment is packed and conveyed, the ejection tray 30 may be folded to the side on which the apparatus body is present as illustrated in FIG. 11.

Note that, in a state where supply of power to the motor 38 is discontinued, the moving mechanism of the ejection tray 30 according to the present exemplary embodiment may be easily moved by an external force, and thus, the ejection tray 30 may be moved to a position at which an end of the ejection tray 30 is positioned below the top surface of the apparatus body by applying a force to the ejection tray 30 from above in a state where the ejection tray 30 is folded.

MODIFICATION

In the above-described exemplary embodiment, although a case has been described in which the present invention is applied to a post-processing apparatus, the present invention is not limited to such a post-processing apparatus. The present invention may also be applied to apparatuses, such as image forming apparatuses including printers and copying machines, each of which includes an ejection tray that receives an ejected printing sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

an ejection tray configured to receive a recording medium that is ejected;

an elastic member configured to urge the ejection tray upward in a vertical direction;

a moving mechanism configured to cause the ejection tray to move up and down in the vertical direction; and a driving source configured to drive the moving mechanism, wherein the moving mechanism comprises a holding plate, wherein the ejection tray is fixed to the holding plate, wherein the elastic member is configured to urge the holding plate upward in the vertical direction, wherein the post-processing apparatus further comprises:

a detector configured to detect a position of the ejection tray; and at least one processor configured to execute a controller configured to estimate a weight of a recording medium placed on the ejection tray using a position detected by the detector, wherein the controller is configured to control vertical movement of the ejection tray when power is supplied to the driving source, wherein the post-processing apparatus is configured such that, when the moving mechanism is not being driven by the driving source, the position of the ejection tray is moved by a total weight of the ejection tray and the recording medium placed on the ejection tray, and wherein the detector includes:

a member that has a plurality of holes having different widths and that is configured to move as the ejection tray moves; and an optical sensor that is fixed to an apparatus body and that is configured to measure the widths of the plurality of holes.

2. The post-processing apparatus according to claim 1, wherein the elastic member is configured to urge the ejection tray upward in the vertical direction by raising the ejection tray.

3. The post-processing apparatus according to claim 1, wherein the ejection tray is attached to the moving mechanism by a hinge structure that enables the ejection tray to be folded to a side on which the apparatus body is present.

4. The post-processing apparatus according to claim 3, wherein the hinge structure is fixed in place in a state where the ejection tray is folded to the side on which the apparatus body is present and in a state where the ejection tray is ready to receive a recording medium that is ejected.

5. The post-processing apparatus according to claim 1, wherein the elastic member is configured to urge the entire ejection tray upward in the vertical direction.

6. A post-processing apparatus comprising:

an ejection tray configured to receive a recording medium that is ejected;

an elastic member configured to urge the ejection tray upward in a vertical direction;

a moving mechanism configured to cause the ejection tray to move up and down in the vertical direction; and a driving source configured to drive the moving mechanism, wherein the ejection tray is attached to the moving mechanism by a hinge structure that enables the ejection tray to be folded to a side on which an apparatus body is present.

7. The post-processing apparatus according to claim 6, wherein the hinge structure is fixed in place in a state where the ejection tray is folded to a side on which an apparatus body is present and in a state where the ejection tray is ready to receive a recording medium that is ejected.

8. A post-processing apparatus comprising:

an ejection tray configured to receive a recording medium that is ejected;

an elastic member configured to urge the ejection tray upward in a vertical direction;

a moving mechanism configured to cause the ejection tray to move up and down in the vertical direction; and a driving source configured to drive the moving mechanism, wherein the moving mechanism comprises a holding plate, wherein the ejection tray is fixed to the holding plate, wherein the elastic member is configured to urge the holding plate upward in the vertical direction, wherein the elastic member is configured to urge the ejection tray upward in the vertical direction by raising the ejection tray, and wherein the ejection tray is attached to the moving mechanism by a hinge structure that enables the ejection tray to be folded to a side on which an apparatus body is present.

9. The post-processing apparatus according to claim 8, wherein the hinge structure is fixed in place in a state where the ejection tray is folded to a side on which an apparatus body is present and in a state where the ejection tray is ready to receive a recording medium that is ejected.

* * * * *